US012409993B2

(12) United States Patent
Riswick et al.

(10) Patent No.: US 12,409,993 B2
(45) Date of Patent: Sep. 9, 2025

(54) BUNDLING OF CONTAINERS

(71) Applicant: H.B. Fuller Comapny, St. Paul, MN (US)

(72) Inventors: Matheus W. Riswick, Hollandsche Rading (NL); Stefan Juers, Lueneburg (DE); Brian W. Carlson, Woodbury, MN (US)

(73) Assignee: H.B. Fuller Company, St. Paul, MN (US)

( * ) Notice: Subject to any disclaimer, the term of this patent is extended or adjusted under 35 U.S.C. 154(b) by 178 days.

(21) Appl. No.: 17/161,885

(22) Filed: Jan. 29, 2021

(65) Prior Publication Data

US 2021/0237954 A1 Aug. 5, 2021

Related U.S. Application Data

(60) Provisional application No. 62/968,503, filed on Jan. 31, 2020.

(51) Int. Cl.
*B65D 71/00* (2006.01)

(52) U.S. Cl.
CPC ..... *B65D 71/0085* (2013.01)

(58) Field of Classification Search
CPC ..... B65D 71/0085; B65D 21/0201; B65D 1/0205; A61J 1/16
USPC ..... 206/431
See application file for complete search history.

(56) References Cited

U.S. PATENT DOCUMENTS 3,924,739 A * 12/1975 Gravesteijn ..... B65D 73/0028 206/160
4,441,611 A * 4/1984 Sommariva ..... B65D 71/0085 206/460
4,505,389 A * 3/1985 Whiteside ..... B65D 71/0085 206/460
5,044,503 A * 9/1991 Wein ..... B65D 5/705 229/125.09
10,414,544 B2 9/2019 Fischer et al.
10,858,145 B2 * 12/2020 Spivey, Sr. ..... B65D 71/36
2012/0160713 A1 6/2012 Bonelli et al.
(Continued)

FOREIGN PATENT DOCUMENTS

DE 4429253 A1 * 2/1996 ..... B65D 71/0085
GB 2136760 9/1984
WO WO2013/004337 1/2013
(Continued)

OTHER PUBLICATIONS

Prior art in NF rejection.*

*Primary Examiner* — Anthony D Stashick
*Assistant Examiner* — Raven Collins
(74) *Attorney, Agent, or Firm* — Kristi Halloran

(57) ABSTRACT

The present invention relates to a container pack comprising a first group of containers and a second group of containers, wherein the first group of containers and the second group of containers each comprise at least one individual container, and wherein each individual container of the first group of containers and second group of containers, is bonded by means of at least one spot of hot melt adhesive to opposing sides of a substrate located between the first group of containers and the second group of containers, wherein the substrate is perforated such that each spot of hot melt adhesive on the substrate is enclosed by a perforation line.

18 Claims, 3 Drawing Sheets

(56) References Cited

U.S. PATENT DOCUMENTS

| | | | | |
|---|---|---|---|---|
| 2015/0034503 | A1 | 2/2015 | Kettwig | |
| 2021/0292605 | A1 * | 9/2021 | Takamori | C09J 7/35 |

FOREIGN PATENT DOCUMENTS

| | | |
|---|---|---|
| WO | WO2013/004340 | 1/2013 |
| WO | WO2015/169699 | 11/2015 |

* cited by examiner

BUNDLING OF CONTAINERS

This application claims the benefit of U.S. Provisional Patent Application No. 62/968,503 filed on Jan. 31, 2020, which is incorporated herein.

FIELD OF THE INVENTION

The present invention relates to a container pack comprising a plurality of individual containers. Each individual container is bonded by means of at least one spot of hot melt adhesive to a substrate, wherein the substrate is perforated such that each spot of hot melt adhesive on the substrate is enclosed by a perforation line.

BACKGROUND OF THE INVENTION

Formation of containers into packs is well-known in the art. Combining several containers, such as for example several cans or bottles, into a container pack provides solid and easily manageable transport units. It is also known to keep the containers bundled into packs using shrink films. However, the environmental impact of waste originating from shrink films is undesirable.

It is known in the art to use hot melt adhesives for bonding containers into packs. For example, WO 2013/004340, U.S. Pat. No. 10,414,544 and WO 2013/004337 describe methods for producing packs of containers by bonding the containers to each other using an adhesive such as a hot melt adhesive. By directly bonding containers such as bottles using an adhesive, waste resulting from shrink wrap with LDPE films on the bottle packs can be avoided. This also saves energy since, for example, shrink wrapping involves six-packs being moved through a heating tunnel which uses large amounts of energy. Furthermore, a smaller packing line footprint and increased packing line speeds are possible. Also, the optical appearance of six-packs is improved, since undesirable creases in the shrink wrap are avoided. This improvement in appearance is highly desirable, because beverage filling companies are concerned about the appearance of their packaged product. Generally, any secondary packaging of container packs can be limited. However, when using an adhesive such as a hot melt adhesive for directly bonding containers to each other, it is necessary to provide on the one hand a reliable bond between the containers. On the other hand, it is also required to ensure easy separation of the containers so that an individual container can be separated from the pack. Generally, a reliable bond can be provided by using a higher adhesive force, i.e. a stronger bond. By contrast, easy separation can be ensured by applying a lower adhesive force. Thus, providing simultaneously for a reliable bond and for easy separation represent conflicting goals.

Thus, there is a need in the art for an improved balance of reliably bonding containers to into packs, while at the same time being easily separable from each other. It is further desirable that the solution does not have a negative impact on recycling and provides a good optical appearance.

SUMMARY OF THE INVENTION

The object of the present invention is to meet the above needs. In particular, an object of the present invention is the provision of a container pack providing on the one hand a reliable bond between the containers, and simultaneously ensuring easy separation of the containers so that an individual container can be separated from the pack.

In one aspect, the invention features a container pack including a first group of containers, a second group of containers, and a substrate, wherein the first group of containers and the second group of containers each comprise at least one individual container, and wherein the at least one individual container of the first group of containers and the at least one individual container of the second group of containers, is bonded by means of at least one spot of hot melt adhesive to opposing sides of the substrate, the substrate being located between the first group of containers and the second group of containers, the substrate being perforated such that each spot of the hot melt adhesive on the substrate is enclosed by a perforation line.

In one embodiment, the perforation line consists of cut lines and uncut lines, wherein the sum of cut lines occupies at least 40% of the total length of the perforation line, preferably 50% to 90%, more preferably 70% to 85% of the total length of perforation line. In another embodiment, the cut line has a length of 1.0 mm to 10 mm, preferably 2.0 mm to 6.0 mm, more preferably 3.0 mm to 5.0 mm, and/or the uncut line has a length of 0.5 mm to 4.0 mm, preferably 0.7 mm to 2.0 mm, more preferably 0.8 mm to 1.5 mm, and/or the total length of the perforation line is 30 mm to 120 mm, preferably 80 mm to 110 mm, more preferably 90 mm to 100 mm. In a different embodiment, each of the perforation lines is in the form of a polygon or is circular, preferably wherein each of the perforation lines is rectangular or circular, more preferably circular.

In one embodiment, each of the individual containers has a total height consisting of an upper half and a bottom half, and wherein the at least one spot of the hot melt adhesive is present in the upper half of the total height of each of the individual containers. In a different embodiment, at least one further spot of the hot melt adhesive is present in the bottom half of each of the individual containers. In another embodiment, each spot of the hot melt adhesive, bonding the individual container of the first group of containers is on a different height than the spot of the hot melt adhesive on the opposite side of the substrate, bonding the individual container of the second group of containers. In a different embodiment, the spots of the hot melt adhesive are in the shape of a line or a circular dot, preferably a circular dot. In one embodiment, the amount of the hot melt adhesive per each spot is 0.1 g to 0.5 g, preferably 0.15 g to 0.3 g.

In a different embodiment, the individual containers of the container pack are in the shape of a bottle, a can, a foil pouch or a rectangular cuboid, preferably the individual containers are in the shape of a rectangular cuboid, more preferably a rectangular cuboid comprises polyethylene. In another embodiment, the first group of containers and the second group of containers each comprise two to six of the individual containers, preferably two to four of the individual containers, more preferably three of the individual containers. In one embodiment, each of the individual containers has a volume of 0.1 liters to 2.0 liters, preferably 0.2 liters to 1.5 liters, more preferably 0.3 liters to 1.2 liters.

In one embodiment, the contents of the individual containers is a food product.

In another embodiment, the substrate is selected from the group consisting of paperboard and plastic material, preferably the substrate is a paperboard, more preferably a paperboard having one layer, two layers, three layers or even more layers.

In another aspect, the invention relates to a container pack (1) comprising a first group of containers (2a) and a second group of containers (2b), wherein the first and second group of containers (2a and 2b) each comprise at least one individual container (3), and wherein each individual container (3) of the first and second group of containers (2a and 2b), respectively, is bonded by means of at least one spot of hot melt adhesive (4) to opposing sides of a substrate (5) located between the first and second group of containers (2a and 2b), wherein the substrate (5) is perforated such that each spot of hot melt adhesive (4) on the substrate (5) is enclosed by a perforation line (6).

The present inventors surprisingly found that when bundling of containers to a perforated substrate, a strong pack formation results, while at the same time an easy pack separation without damage to the primary packages is possible. Thus, the bundling of containers to a perforated substrate replaces the conventional shrink wrap film and additionally provides an easy recyclable packaging solution. The main benefit of the present invention is that there is a very strong and secured bundling of containers and there is a very good adhesion of the containers to the substrate. When the containers are removed off the substrate, there is a clean cut of the perforation out of the board. The advantage of the present invention versus other solutions (like only adhesive) is that the solution according to the invention gives a very strong pack and at the same time an easy to remove single item. The container is removed from the container pack with a clear cut of the perforated substrate and without tears and/or fibers on the final packaging. When using e.g. aseptic packaging, the packs/bricks can be recycled e.g. in a special paper recycling process and the hot melt adhesive does not have a negative impact on the recycling process and can be easily removed in the process. In addition, the perforated packaging which is removed from the board can give a 3D image on the pack and therefore can be used as an extra branding or advertising tool.

Further features of the present invention are apparent from the following detailed description as well as the appended figures and dependent claims.

DETAILED DESCRIPTION OF THE INVENTION

Figure 1:
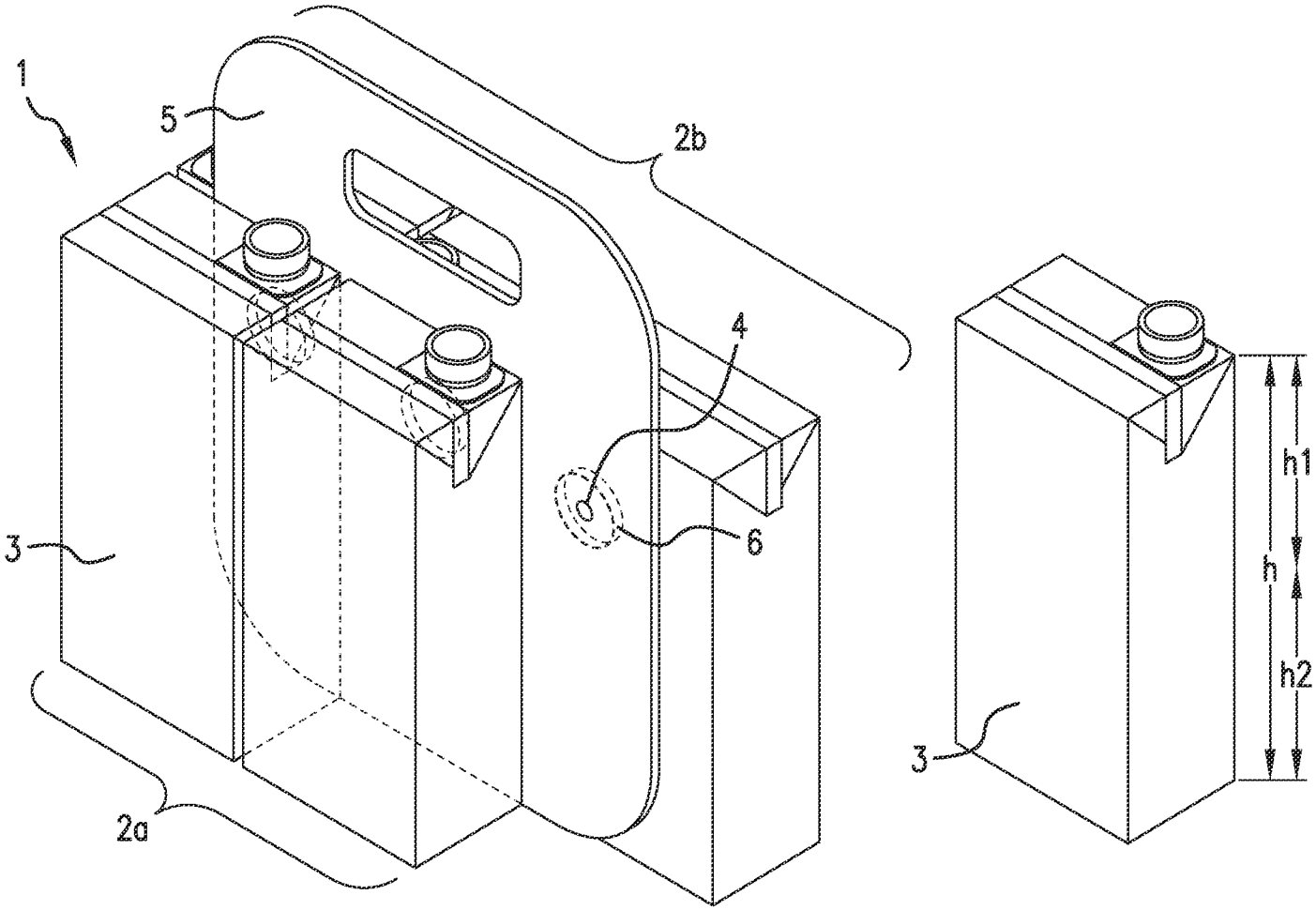
FIG. 1 shows a container pack in accordance with one or more embodiments of the present invention

As outlined above, the present invention relates to a container pack (1) comprising a first group of containers (2a) and a second group of containers (2b). The first group of containers (2a) and the second group of containers (2b) each comprise at least one individual container (3), such as at least two individual containers (3). Each individual container (3) of the first group of containers (2a) is bonded by means of at least one spot of hot melt adhesive (4) to one side of a substrate (5). Furthermore, each individual container (3) of the second group of containers (2b) is bonded by means of at least one spot of hot melt adhesive (4) to the side of the substrate (5) opposing the side where the first group of containers (2a) is bonded. Thus, the substrate (5) is located in the container pack (1) of the invention between the first group of containers (2a) and the second group of containers (2b). According to the present invention, the substrate (5) is perforated such that each spot of hot melt adhesive (4) on the substrate (5) is enclosed by a perforation line (6).

An illustrative container pack (1) in accordance with the present invention is shown in FIG. 1. The container pack (1) comprises a first group of containers (2a) and a second group of containers (2b). Each group of containers (2a and 2b) comprises a number of individual containers (3). The individual containers (3) are bonded to a substrate (5) by means of a spot of hot melt adhesive (4). The first group of containers (2a) is bonded to the side of the substrate (5) opposite to the side where the second group of containers (2b) is bonded such that the substrate (5) is in-between. The spots of hot melt adhesive are enclosed by perforation lines (6).

In one embodiment of the container pack (1) of the present invention, the perforation line (6) in the substrate (5) consists of cut lines and uncut lines, wherein the sum of cut lines occupies at least about 40% of the total length of the perforation line (6). In a preferred embodiment, the sum of cut lines occupies about 50% to about 90% of the total length of the perforation line (6). In another preferred embodiment, the sum of cut lines occupies about 70% to about 85% of the total length of perforation line (6).

In one embodiment in accordance with the above, each cut line has a length of about 1.0 mm to about 10 mm. In a preferred embodiment, each cut line has a length of about 2.0 mm to about 6.0 mm. More preferably, each cut line has a length of about 3.0 mm to about 5.0 mm. The length of the respective cut lines in the perforation line (6) may be the same or different. However, in view of the ease of manufacture, the length of each individual cut line typically is the same.

In one further embodiment, each uncut line has a length of about 0.5 mm to about 4.0 mm. In another embodiment, each uncut line has a length of about 0.7 mm to about 2.0 mm. More preferably, each uncut line has a length of about 0.8 mm to about 1.5 mm. The length of the uncut lines corresponds to the distance between the cut lines. According to the present invention, the distance between the cut lines—and, thus, the length of the uncut lines—may vary. However, in view of the ease of manufacture, the length of each uncut line typically is the same.

The total length of the perforation line (6) is not specifically limited as long as the spot of hot melt adhesive (4) can be enclosed. In one embodiment, the total length of each perforation line (6) is about 30 mm to about 120 mm. The total length of a perforation line (6) defines according to the present invention the length of the circumference enclosing a spot of hot melt adhesive (4). The total length of an individual perforation line (6) represents the sum of cut lines and uncut lines forming the respective perforation line (6). In a preferred embodiment, the total length of an individual perforation line is about 80 mm to about 110 mm. More preferably, the total length of an individual perforation line is about 90 mm to about 100 mm. According to the present invention, the length of the respective perforation lines (6) may vary. However, in view of the ease of manufacture, the total length of each individual perforation line (6) typically is the same.

According to the present invention, the perforation line (6) encloses a spot of hot melt adhesive (4) on the substrate (5). The shape of the perforation line (6) according to the present application is not particularly limited and may be any closed shape. For example, the perforation line (6) may have the shape of a polygon, e.g. a polygon having three, four, five or six corners. In an alternative embodiment, the perforation line has a more or less rounded shape, such as a circle or an ellipse. In a preferred embodiment, the perforation lines (6) are rectangular or circular in shape. More preferably, each perforation line is (more or less) circular. "Circular" in the sense of the present invention when referring to the shape of the perforation lines (6) does not require a perfect circle in the mathematical sense. Rather, any shape resembling a circle from a macroscopic viewpoint is considered "circular" according to this aspect of the present invention.

The shape of the individual perforation lines (6) may vary according to the present invention. However, in view of the case of manufacture, the shape of the perforation lines (6) typically is the same.

Figure 2:
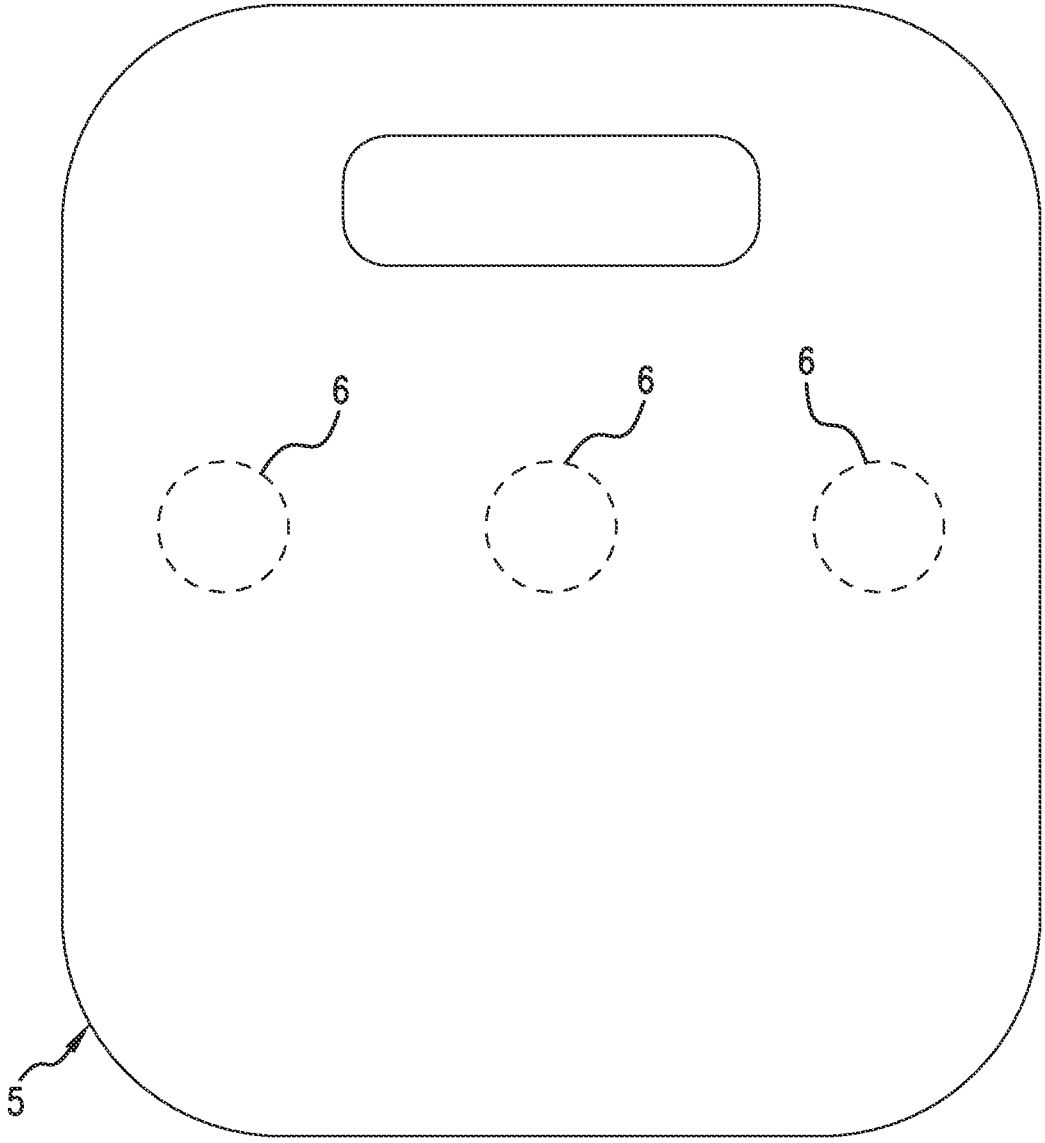
FIG. 2 shows a substrate having perforation lines according to an embodiment of the present invention.

As shown in FIG. 1, the individual containers (3) have a total height (h) consisting of an upper half (h1) and a bottom half (h2). In one embodiment, the at least one spot of hot melt adhesive (4) bonding each individual container (3) to the substrate (5) is present in the upper half (h1) of the total height (h) of each individual container (3). Accordingly, the perforation line (6) on the substrate (5) enclosing the spot of hot melt adhesive (4) is present in a position corresponding to the upper half (h1) of an individual container (3) when the container pack (1) of the present invention is formed. An illustrative embodiment of a substrate (5) suitable according to this embodiment of the present invention is exemplified in FIG. 2.

In another embodiment in accordance with the above, at least one further spot of hot melt adhesive (4) may further be present in the bottom half (h2) of each individual container (3). Thus, according to this embodiment, the substrate (5) has perforation lines (6) enclosing a spot of hot melt adhesive (4) in a position corresponding to the upper half (h1) of an individual container (3) and additionally has perforation lines (6) in a position corresponding to the bottom half (h2) of an individual container (3) when the container pack (1) of the present invention is formed.

According to an embodiment of the container pack (1) of the present invention, each spot of hot melt adhesive (4) bonding an individual container (3) of the first group of containers (2a) is on a different height (h) than the spot of hot melt adhesive (4) on the corresponding opposite side of the substrate (5) bonding the individual container (3) of the second group of containers (2b). The spots of hot melt adhesive (4) for bonding individual containers (3) of the first group of containers (2a) can be along the vertical axis of each individual container (3) on a different height (h) than the spots of hot melt adhesive (4) bonding the individual containers (3) of the second group of containers (2b) on the opposite side, or can be staggered in a diagonal fashion on opposing sides of the substrate (5). According to this embodiment, the substrate (5) has two perforation lines (6) in the area corresponding to the upper half (h1) of an individual container (3).

Figure 3:
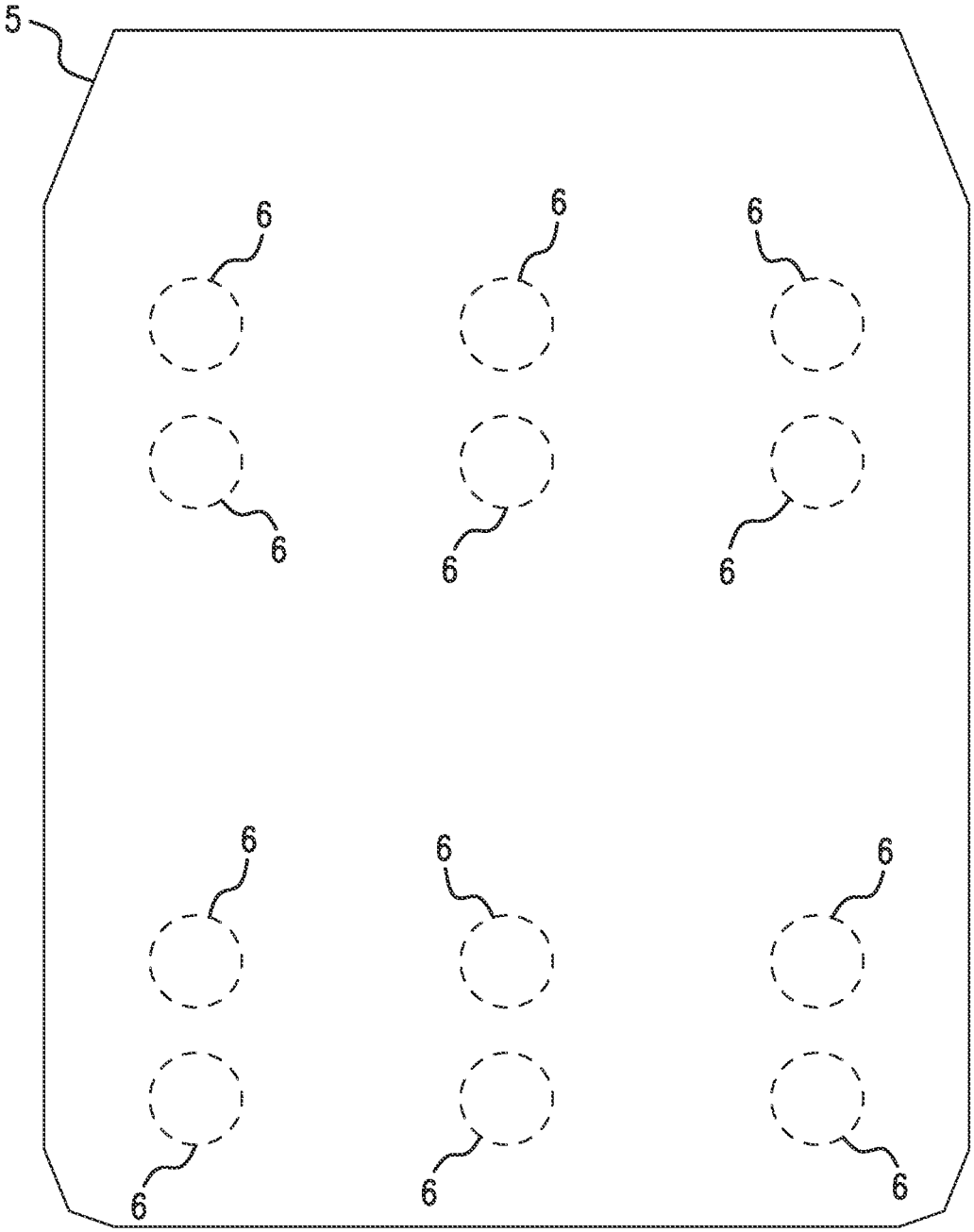
FIG. 3 shows a substrate having perforation lines in accordance with another embodiment of the present invention.

In an alternative embodiment, the substrate (5) has two additional perforation lines (3) in the area corresponding to the bottom half (h2). The perforation lines (6) for enclosing the one or more spots of hot melt adhesive for bonding an individual container (3) of the first group of containers (2a) and the perforation lines (6) for enclosing the one or more spots of hot melt adhesive for bonding the corresponding individual container (3) of the second group of containers (2b) on the opposite side of the substrate (5) may be arranged on the same axis corresponding to the vertical axis of the individual containers (3), or may be staggered in a diagonal way. An illustrative embodiment of a substrate (5) suitable according to this embodiment of the present invention is exemplified in FIG. 3.

The type of containers (3) is not specifically limited according to the present invention. The term "containers" may refer to bottles, cans, tubes, or pouches, made in each case of metal, glass, plastic, and/or a material composite, typically, for example, polyethylene terephthalate (PET) bottles, or a material composite of plastic, aluminium foil, and paper. Other plastic container materials suitable according to the invention include but are not limited to polyethylene (PE), including bio-PE, polypropylene (PP), or biobased material and/or compostable material, such as e.g. polylactic acid (PLA), polybutylene succinate (PBS), and polyhydroxyalkanoates (PHA), etc. In general, the term encompasses structures that are suitable for the filling of solid, fluid or viscous products. The containers (3) can have any desired cross-section. Embodiments include those in which containers have a circular cross-section and containers having an oval or angular cross-sections. Also, the containers (3) can also have any of a variety of shapes. Examples of such containers are pouches, pyramidal containers, and cubic containers, as well as cylindrical containers, such as cans. Also included are containers with a non-uniform cross section, such as bottles that taper towards an opening. Also included are bottles that stand at lower ends thereof only on point-shaped support regions, and that have cross-sections that transition from the point-shaped support regions to the basic body and into the cylindrical bottle wall.

In one embodiment, the individual containers (3) are in the shape of a bottle, such as a PET bottle, a can, such as a (coated) tin can, a foil pouch or a rectangular cuboid. In a preferred embodiment, the individual containers (3) are in the shape of a rectangular cuboid. Examples of container (3) suitable according to the invention include a rectangular cuboid comprising a polyethylene (PE) outer layer, such as e.g. commercially available Tetra Brik Aseptic manufactured by Tetra Pak, or Tetra Rex Bio-based, including bio-PE.

The first group of containers (2a) and the second group of containers (2b) typically comprise the same number of individual containers (3). For example, the first group of containers (2a) and the second group of containers (2b) each comprise at least one, such as two to six individual containers, so that the container pack (1) according to the invention comprises a total of two to twelve, such as four to twelve individual containers (3). In other embodiments, the first group of containers (2a) and the second group of containers (2b) each comprise two to four individual containers (3). In a preferred embodiment, the first group of containers (2a) and the second group of containers (2b) each comprise three individual containers (3), forming a conventionally known six-pack.

The size, i.e. the volume, of the individual containers (3) is not specifically limited according to the present invention. For example, the individual containers (3) may have a volume of 0.11 to 2.01. In another embodiment, the individual containers (3) may have a volume of 0.21 to 1.51, such as 0.31 to 1.21.

The contents of the individual containers (3) is not specifically limited according to the invention. In one embodiment, the contents include a food product. The term food product is not intended to be limited but rather includes both solid foods (e.g. yogurt, apple sauce, snack foods (e.g. chips, crackers, cookies, etc.), pasta, rice, etc.), liquid foods (soup, broth, etc.), food ingredients (flour, sugar, etc.), beverages (milk, juice, carbonated beverages, etc.), or any other solid or liquid consumed by humans or animals. In one embodiment, the containers (3) contain a food product, such as a beverage. In another embodiment, the containers (3) may include a shower gel, a dishwashing detergent or a laundry detergent, etc.

The hot melt adhesive is applied according to the invention discontinuously, i.e. in the form of spots. The shape of the spots of hot melt adhesive (4) is according to the present invention not specifically limited. For example, the spots of hot melt adhesive (4) may have the shape of a line or a (more or less) circular dot. In a preferred embodiment, the spots of hot melt adhesive (4) are in the shape of a circular dot. The term "circular dof" according to the present invention does, however, not require a perfect circle in the mathematical sense but refers to the shape obtained by pointwise application of hot melt adhesive by techniques in principle known in the art.

The amount of hot melt adhesive per each spot (4) is according to the invention not specifically limited and may be selected e.g. in view of the type and weight of the individual containers (3). In an illustrative embodiment, each spot of hot melt adhesive (4) comprises 0.05 g to 0.8 g, 0.1 g to 0.5 g, or even 0.15 g to 0.3 g of hot melt adhesive. The hot melt adhesive also may be applied in foamed form. Typically, the coating weight, i.e. the amount of adhesive can be reduced when using the adhesive in foamed form, because the foamed adhesive is spreading more, so that it is easier to get a better and clean removal of the area enclosed by the perforation line (6) without fiber tear.

Furthermore, the type of hot melt adhesive is not specifically limited according to the invention. Conventional hot melt adhesives as known in the art may be used. The hot melt adhesive can be a pressure sensitive hot melt adhesive or a non-pressure sensitive hot melt adhesive. The hot melt adhesive can have a Brookfield Viscosity @ 177° C. of less than 6,000 cP, less than 5,000 cP, or even from 250 cP to 2000 cP.

For example, useful hot melt adhesives can include polymer, tackifying agent and wax. The type of polymer is not specifically limited. Useful polymers can include styrene block copolymers, olefin polymers (e.g. ethylene based olefin polymers, propylene based olefin polymers, etc.), modified olefin polymers (e.g. maleic anhydride modified polymers) and ethylene polar comonomer copolymers.

Useful hot melt adhesives can include ethylene alpha olefin or ethylene polar comonomer copolymer, tackifying agent and wax.

Ethylene Alpha-Olefin Copolymer The ethylene alpha-olefin copolymer typically has a density of no greater than 0.90 grams per cubic centimeter (g/cm$^3$), or even no greater than 0.89 g/cm$^3$. The ethylene alpha-olefin copolymer typically exhibits a melt index (according to ASTM-D 1238 at 190° C., 2.16 kg weight) of from about 1 g/10 minutes (min) to about 2500 g/10 min, or even from about 400 g/10 min to about 1200 g/10 min.

The alpha-olefin monomer has at least three carbon atoms, or even from three to 20 carbon atoms, suitable examples of which include propylene, isobutylene, butene, pentene, hexene, heptene, octene, nonene, decene, dodecene, 4-methyl-1-pentene, 3-methyl pentene-1,3,5,5-trimethyl-hexene-1, 5-ethyl-1-nonene, and combinations thereof. Specific examples of suitable ethylene copolymers include ethylene-propylene, ethylene-butene, ethylene-hexene, ethyene-octene, and combinations thereof. The ethylene alpha-olefin copolymer optionally includes functional groups including, e.g., carboxylic acid groups, anhydride groups (e.g., maleic anhydride), and combinations thereof.

The ethylene alpha-olefin copolymer can be prepared using a variety of catalysts including, e.g., a single site catalyst (e.g., metallocene catalysts (e.g., metallocene catalyzed ethylene alpha-olefin copolymers), constrained geometry catalysts (e.g., homogeneous linear or substantially linear ethylene alpha-olefin interpolymers prepared from ethylene and an alpha-olefin comonomer using a constrained geometry catalyst and having a polydispersity index of no greater than 2.5 and long chain branching)), multiple single site catalysts, and combinations thereof.

Useful ethylene alpha-olefin copolymers include ethylene alpha-olefin copolymers polymerized to their final molecular weight in reactor, ethylene alpha-olefin copolymers subjected to chain scission to achieve their final molecular weight, and mixtures thereof.

Useful ethylene alpha-olefin copolymers are commercially available under of a variety of trade designations including, e.g., the AFFINITY series of trade designations from DowDuPont Chemical Company (Midland, Michigan) including, e.g., AFFINITY GA 1875, AFFINITY GA 1900, and AFFINITY GA 1950 ethylene-octene elastomers, AFFINITY GA 1000R maleic anhydride-modified ethylene-octene copolymer (which is also referred to as an interpolymer by the manufacturer), and AFFINITY ethylene-propylene copolymers, the ENGAGE series of trade designations from DowDuPont Chemical Company (Midland, Michigan) including ENGAGE 8400, ENGAGE 8401, and ENGAGE 8402 ethylene-octene copolymers, the QUEO series of trade designations from *Borealis*, the INFUSE series of trade designations from DowDuPont Chemical Company (Midland, Michigan) including INFUSE 9500 ethylene-ethylene-propylene copolymer, the SABIC POE series of trade designations from Saudi Basic Industries Corp. (Pittsfield, Massachusetts) including SABIC POE C30070D, the LUCENE series of trade designations from LG, the TAFMER series of trade designations from MITSUI, and the EXACT series of trade designations from ExxonMobil Chemical Company (Houston, Texas) including, e.g., EXACT 9061 ethylene butene copolymer.

Ethylene-Polar Comonomer Copolymer

The term "ethylene-polar comonomer copolymer," as used herein, refers to copolymers, terpolymers and higher order polymers of ethylene and a polar comonomer. The ethylene-polar comonomer copolymer is derived from ethylene and no greater than 45% by weight of the polar co-monomer. Useful polar co-monomers include vinyl acetate and alkyl acrylates (e.g., $C_1$-$C_4$ alkyl acrylate).

Useful ethylene-polar comonomer copolymers exhibit a melt index (according to ASTM-D 1238 at 190° C., 2.16 kg weight) of less than 3000 g/10 min, less than 2600 g/10 min, less than 1100 g/10 min, at least 5 g/10 min, at least 50 g/10 min, at least 100 g/10 min, from 5 to 3,000 g/10 min, or even from 5 to 1100 g/10 min. Suitable ethylene-polar comonomer copolymers include no greater than 40% by weight, no greater than 35% by weight, from 10% by weight to 40% by weight, or even from 15% by weight to 35% by weight of the polar comonomer.

Suitable ethylene-polar comonomer copolymers include, e.g., ethylene vinyl acetate, ethylene methyl acrylate, ethylene ethyl acrylate, ethylene n-butyl acrylate, ethylene acrylic acid, ethylene methyl-methacrylate, ethylene 2-ethylhexyl acrylate, and combinations thereof.

Suitable copolymers of ethylene vinyl acetate are commercially available under the ATEVA series of trade designations including ATEVA 1850A and 1880A from AT Plastics, Inc. (Edmonton, Alberta, Canada), and the ESCORENE series of trade from ExxonMobil Chemical Company (Houston, Texas), and ALCUDIA PA-407, PA-410 PA-411 and PA-420, or Primeva P2836M and P2850M from REPSOL (Madrid, Spain).

Useful ethylene n-butyl-acrylate copolymers are commercially available under the ALCUDIA trade designations including PA-27100 and PA-27150 from Repsol (Madrid, Spain) and the ENABLE trade designations from Exxon Chemical (Houston, Texas). Suitable ethylene methyl acrylate copolymers are commercially available under the OPTEMA trade designations from Exxon Chemical (Houston, Texas). Useful ethylene methyl-methacrylate copolymers are commercially available under the ACRYFT trade designations from Sumitomo Chemical Company (Tokyo, Japan).

Tackifying Agent

The tackifying agent can be a liquid. Alternatively, the tackifying agent can exhibit a glass transition temperature (Tg) of from about 30° C. to about 90° C. Suitable classes of tackifying agents include, e.g., aromatic, aliphatic and cycloaliphatic hydrocarbon resins, mixed aromatic and aliphatic modified hydrocarbon resins, aromatic modified aliphatic hydrocarbon resins, and hydrogenated versions thereof; terpenes, modified terpenes and hydrogenated versions thereof; natural rosins, modified rosins, rosin esters, and hydrogenated versions thereof; low molecular weight polylactic acid; and combinations thereof. Examples of useful natural and modified rosins include gum rosin, wood rosin, tall oil rosin, distilled rosin, hydrogenated rosin, dimerized rosin, and polymerized rosin. Examples of useful rosin esters include e.g., glycerol esters of pale wood rosin, glycerol esters of hydrogenated rosin, glycerol esters of polymerized rosin, pentaerythritol esters of natural and modified rosins including pentaerythritol esters of pale wood rosin, pentaerythritol esters of hydrogenated rosin, pentaerythritol esters of tall oil rosin, phenolic-modified pentaerythritol esters of rosin, and combinations thereof. Examples of useful polyterpene resins include polyterpene resins having a softening point, as determined by ASTM method E28-58T, of from about 80° C. to about 160° C., hydrogenated polyterpene resins, and copolymers and terpolymers of natural terpenes (e.g. styrene-terpene, alpha-methyl styrene-terpene and vinyl toluene-terpene), and combinations thereof. Examples of useful aliphatic and cycloaliphatic petroleum hydrocarbon resins include aliphatic and cycloaliphatic petroleum hydrocarbon resins having Ring and Ball softening points of from about 80° C. to 160° C., the hydrogenated derivatives thereof, and combinations thereof. Suitable aliphatic and cycloaliphatic petroleum hydrocarbon resins include, e.g., branched, unbranched, and cyclic Cs resins, $C_9$ resins, and $C_{10}$ resins.

Useful tackifying agents are commercially available under a variety of trade designations including, e.g., the ESCOREZ series of trade designations from ExxonMobil Chemical Company (Houston, Texas) including, e.g., ESCOREZ 1310LC aliphatic hydrocarbon resin, ESCOREZ 5400 cycloaliphatic hydrocarbon resin, ESCOREZ 5637 aromatic modified, cycloaliphatic hydrocarbon resin, ESCOREZ 5415 cycloaliphatic hydrocarbon resin, ESCOREZ 5600 aromatic modified, cycloaliphatic hydrocarbon resin, ESCOREZ 5615 aromatic modified, cycloaliphatic hydrocarbon resin, and ESCOREZ 5690 aromatic modified, cycloaliphatic hydrocarbon resin, the EASTOTAC series of trade designations from Eastman Chemical Company (Kingsport, Tennessee) including, e.g., EASTOTAC H-100R, EASTOTAC H-100L, and EASTOTAC H130W hydrogenated hydrocarbon resins, the WINGTACK series of trade designations from Cray Valley HSC (Exton, Pennsylvania) including, e.g., WINGTACK 86 aromatically modified, C-5 hydrocarbon resin, WINGTACK EXTRA aromatically modified, C-5 hydrocarbon resin, and WINGTACK 95 aliphatic C-5 petroleum hydrocarbon resin, the PICCOTAC series of trade designations from Eastman Chemical Company (Kingsport, Tennessee) including, e.g., PICCOTAC 8095 aromatically modified, C-5 hydrocarbon resin and 1115 hydrocarbon resin, the ARKON series of trade designations from Arkawa Europe GmbH (Germany) including, e.g., ARKON P-125 alicyclic saturated hydrocarbon resin, the REGALITE and REGALREZ series of trade designations from Eastman Chemical Company including, e.g., REGALITE R1125 fully hydrogenated hydrocarbon resin and REGALREZ 1126 hydrocarbon resin, and the RESINALL series of trade designations from Resinall Corp (Severn, North Carolina) including RESINALL R-1030 hydrogenated hydrocarbon resin.

Wax

The hot melt adhesive composition can include a wax. The wax can be selected from the group consisting of synthetic wax (e.g. polyethylene waxes, Fischer Tropsch waxes and metallocene catalyzed polyethylene waxes), paraffin waxes, microcrystalline waxes, polypropylene waxes, functional waxes, and combinations thereof.

The type of substrate material suitable for the substrate (5) according to the invention is not specifically limited as long as the strength thereof is high enough to support the total weight first and second groups of containers (2a and 2b). Furthermore, the size of the substrate is not specifically limited but is selected such that at least the area between first and second groups of containers (2a and 2b) is covered. Thus, the selection of suitable substrate material depends on the size, weight and number of individual containers (3) in the container pack (1). A person skilled in the art will be able to select suitable substrate materials in accordance with the teaching of the present invention.

In one embodiment, the substrate (5) is selected from the group consisting of paperboard and plastic material. The plastic material may include, for example, polyethylene (PE), including bio-PE, polypropylene (PP), polyethylene terephthalate (PET), or biobased material and/or compostable material, such as e.g. polylactic acid (PLA), polybutylene succinate (PBS), polyhydroxyalkanoates (PHA), etc. In a preferred embodiment, the substrate(S) is a paperboard. According to this preferred embodiment, the total amount of plastic material in a container pack can be further reduced. The paperboard may have one layer, two layers, three layers or even more layers. Furthermore, the paperboard substrate can be corrugated or non-corrugated. In an illustrative non-limiting embodiment, the substrate (5) may for example be a paperboard having a total area weight (grammage) of 250 g/m$^2$ or more, preferably, 300 to 700 g/m$^2$, such as 350 to 600 g/m$^2$.

The substrate (5) may include further perforation lines in addition to those used for enclosing spots of hot melt adhesive (4) for bonding individual containers (3). For example, the substrate (5) may further have a perforation line defining a handle. A perforation line defining a handle in the substrate is typically present in the center of the substrate above the section occupied by the individual containers (3). If a handle is present, the size of the substrate material illustrated above is selected such that there is enough space above the containers (3) for the handle and the area around the handle supporting it.

The method for preparing the container pack (1) according to the invention is not specifically limited. Typically, a substrate, such as for example a paperboard, is provided in a first step with perforation lines (6) at the desired positions. Alternatively, a suitable substrate (5) already having perforation lines (6) at the desired positions can be employed.

Then, hot melt adhesive is applied in the form of spots (4) onto the areas enclosed by perforation lines (6) intended to bond the first group of containers (2a). Alternatively, the spots of hot melt adhesive (4) may also directly be applied to the individual container (3) at positions corresponding to the areas enclosed by perforation lines (6) on the substrate (5). Afterwards, the individual containers (3) of the first group of containers (2a) are attached to the substrate (5). Subsequently, the procedure is repeated in a similar way on the opposite side of the substrate (5) for attaching the individual containers of the second group of containers (2b).

Alternatively, the spots of hot melt adhesive (4) may be applied at both opposing surfaces of the 5 substrate (5) before the containers of the first and second group are attached, and afterwards the individual containers (3) of the first and second group of containers (2a and 2b) may be attached simultaneously or almost simultaneously. It is also possible according to this embodiment that alternatively the spots of hot melt adhesive (4) are applied directly onto the containers (3) in positions corresponding to the areas enclosed by the perforation lines (6) on the substrate (5).

EXAMPLE

A paperboard comprising three layers of paper (146 g/m$^2$ liner, 117 g/m$^2$ fluting, 181 g/m$^2$ liner) was provided with two groups of respectively three perforations lines each having a total length of about 95 mm. The length of the cut lines in each case was 3.96 mm, and the length of the uncut lines in each case was 1 mm. The location of the perforation lines was selected such the containers to be attached subsequently can be bonded at the upper half thereof.

A spot of hot melt adhesive 0.3-0.6 grams was applied to three perforation lines on one side of the paperboard. Subsequently, three Tetra Brik Aseptic containers having a size of 1 liter were attached to said side of the paperboard. Afterwards, the procedure was repeated on the opposing side of the paperboard to provide a six-pack of containers.

Bonding performance in the six-pack was found to be good i.e. the six-pack held together well when shook vigorously by hand.

On the other hand, individual containers easily could be removed from the six-pack with low force, and without fiber tear or damage to the containers.

What is claimed is:

1. A container pack comprising:

a first group of containers, a second group of containers, and a single planar substrate, wherein the first group of containers and the second group of containers each comprise at least one individual container, and wherein the at least one individual container of the first group of containers and the at least one individual container of the second group of containers, are bonded by means of at least one spot of hot melt adhesive to opposing sides of the single planar substrate, the single planar substrate located between the first group of containers and the second group of containers, wherein each spot of the hot melt adhesive, bonding the individual container of the first group of containers is on a different height than the spot of the hot melt adhesive on the opposite side of the single planar substrate, bonding the individual container of the second group of containers, the single planar substrate being perforated such that each spot of the hot melt adhesive on the single planar substrate is enclosed by a perforation line, a portion of the substrate within the perforated lines remains attached to the container once removed from the substrate.

2. The container pack of claim 1, wherein the perforation line consists of cut lines and uncut lines, and wherein the sum of the cut lines occupies at least 40% of the total length of the perforation line.

3. The container pack of claim 2, wherein the cut line has a length of 1.0 mm to 10 mm.

4. The container pack of claim 1, wherein each of the perforation lines is in the form of a polygon.

5. The container pack of claim 4, wherein the polygon is selected from the group consisting of a rectangle and a circle.

6. The container pack of claim 1, wherein each of the individual containers has a total height consisting of an upper half and a bottom half, and wherein the at least one spot of the hot melt adhesive is present in the upper half of the total height of each of the individual containers.

7. The container pack of claim 6, wherein at least one further spot of the hot melt adhesive is present in the bottom half of each of the individual containers.

8. The container pack of claim 1, wherein the individual containers are rectangular cuboids comprising polyethylene.

9. The container pack of claim 1, wherein the first group of containers and the second group of containers each comprise two to six of the individual containers.

10. The container pack of claim 1, wherein each of the individual containers has a volume of 0.1 liters to 2.0 liters.

11. The container pack of claim 1, wherein the contents of the individual containers is a food product.

12. The container pack of claim 1, wherein the contents of the individual containers is a beverage.

13. The container pack of claim 1, wherein the spots of the hot melt adhesive are selected from the group consisting of a line and a circular dot.

14. The container pack of claim 1, wherein the amount of the hot melt adhesive per each spot is 0.1 g to 0.5 g.

15. The container pack of claim 1, wherein the single planar substrate is selected from the group consisting of paperboard and plastic material.

16. The container pack of claim 1 wherein the single planar substrate is paperboard.

17. The container pack of claim 1 wherein the hot melt adhesive composition comprises a polymer selected from the group consisting of ethylene alpha olefin and ethylene polar comonomer.

18. The container pack of claim 1 wherein the container is a rectangular cuboid.

* * * * *